United States Patent [19]

Korenko

[11] Patent Number: 4,578,130

[45] Date of Patent: Mar. 25, 1986

[54] IRON-NICKEL-CHROMIUM ALLOY HAVING IMPROVED SWELLING RESISTANCE AND LOW NEUTRON ABSORBENCE

[75] Inventor: Michael K. Korenko, Richland, Wash.

[73] Assignee: The United States of America as represented by the United States Department of Energy, Washington, D.C.

[21] Appl. No.: 180,770

[22] Filed: Aug. 22, 1980

Related U.S. Application Data

[63] Continuation of Ser. No. 61,228, Jul. 27, 1979, abandoned.

[51] Int. Cl.[4] ..... C22C 30/00

[52] U.S. Cl. ..... 148/419; 148/158

[58] Field of Search ..... 75/122, 171, 134 F; 148/32, 31, 32.5, 142, 158, 162

[56] References Cited

U.S. PATENT DOCUMENTS 3,046,108 7/1962 Eiselstein ..... 75/171
3,663,213 5/1972 Eiselstein et al. ..... 75/124
3,705,827 12/1972 Muzyka et al. ..... 75/122
4,236,943 12/1980 Korenko et al. ..... 75/134 F

FOREIGN PATENT DOCUMENTS 999439 7/1965 United Kingdom .
1514241 6/1978 United Kingdom .

OTHER PUBLICATIONS

Huntington Alloys, "Inconel Alloy 706", 1974, Int'l. Nickel Co., Inc., pp. 1-13.

*Primary Examiner*—R. Dean
*Attorney, Agent, or Firm*—John J. Prizzi

[57] ABSTRACT

An iron-nickel-chromium age-hardenable alloy suitable for use in fast breeder reactor ducts and cladding which utilizes the gamma-double prime strengthening phase and characterized in having a delta or eta phase distributed at or near grain boundaries. The alloy consists essentially of about 33-39.5% nickel, 7.5-16% chromium, 1.5-4% niobium, 0.1-0.7% silicon, 0.01-0.2% zirconium, 1-3% titanium, 0.2-0.6% aluminum, and the remainder essentially all iron. Up to 0.4% manganese and up to 0.010% magnesium can be added to inhibit trace element effects.

1 Claim, No Drawings

IRON-NICKEL-CHROMIUM ALLOY HAVING IMPROVED SWELLING RESISTANCE AND LOW NEUTRON ABSORBENCE

GOVERNMENT CONTRACTS

The invention described herein was made during the course of or in performance of work under U.S. Government Contract No. EY-76C-14-2170 under the auspices of ERDA.

This is a continuation of application Ser. No. 61,228, filed July 27, 1979, now abandoned.

BACKGROUND OF THE INVENTION

While not limited thereto, the present invention is particularly adapted for use as a fast breeder reactor duct and fuel rod cladding alloy. Such an alloy requires strong mechanical properties at high temperatures and at the same time must have both swelling resistance under the influence of irradiation and low neutron absorbence. Alloys such as those described in U.S. Pat. No. 3,046,108 to Eiselstein disclose age-hardenable nickel-chromium base alloys which have high strength and good ductility over a wide temperature range up to about 1400° F. The aforesaid patent discloses a nickel-base alloy having a nominal composition consisting essentially of about 53% nickel, 19% chromium, 3% molybdenum, 5% niobium, 0.2% silicon, 0.2% manganese, 0.9% titanium, 0.45% aluminum, 0.04% carbon and the balance essentially iron. The alloy is characterized in the age-hardened condition by a yield strength (0.2% offset) of at least 100,000 pounds per square inch at room temperature and by a 100-hour rupture strength of at least 90,000 psi at 1200° F.

It is known that nickel-base alloys containing titanium and aluminum, such as those described in U.S. Pat. No. 3,046,108, are strengthened by precipitation of a gamma-prime phase. It has also been found that by adjusting the amounts of titanium, aluminum and niobium in such alloys, a morphology can be obtained wherein precipitated gamma-prime particles are coated on their six faces with a shell of gamma-double prime precipitate. The resulting microstructure is very stable on prolonged aging and has good thermal stability characteristics.

In copending application Ser. No. 917,832, filed June 22, 1978, now U.S. Pat. No. 4,236,943 issued on Dec. 2, 1980 and assigned to the assignee of the present application, an iron-nickel-chromium alloy is described which incorporates the gamma-prime and gamma-double prime phases to achieve high strength mechanical properties at elevated temperatures as well as good swelling resistance in response to irradiation. The alloy described in the aforesaid copending application contains about 0.3% aluminum, about 1.7% titanium, about 45% nickel, about 10% chromium and about 1.7% niobium.

SUMMARY OF THE INVENTION

The present invention resides in the discovery that the desirable properties of the alloy described in the aforesaid copending application Ser. No. 917,832, U.S. Pat. No. 4,236,943 can be further enhanced by reducing the nickel content to about 35% and critically limiting the aluminum content. Specifically, the improved alloy of the invention has a lower neutron absorption cross section than alloys containing higher amounts of nickel; has less tendency to form faulted dislocations; has higher post irradiation ductility; and, at the same time, has high swelling resistance in response to irradiation. The alloy of U.S. Pat. No. 3,046,108 has a neutron absorption cross section which is 56% higher than that of AISI 316. The alloys of this disclosure have cross sections on the order of 27% higher than that of AISI 316—a significant improvement! Furthermore, the ductility of the alloy can be improved by an appropriate heat treatment.

The above and other objects and features of the invention will become apparent from the following detailed description of exemplary embodiments of the invention:

DESCRIPTION OF THE PREFERRED EMBODIMENTS

The broad and preferred compositions of the alloy of the invention are listed in the following Table I:

TABLE 1

| | Broad - % | Preferred - % |
|---|---|---|
| Nickel | 33–39.5 | 37 |
| Chromium | 7.5–16 | 12 |
| Niobium | 1.5–4 | 2.9 |
| Silicon | .1–.7 | .2 |
| Zirconium | .01–0.2 | 0.05 |
| Titanium | 1–3 | 1.75 |
| Aluminum | .2–.6 | .3 |
| Carbon | .02–.1 | .03 |
| Boron | .002–.015 | .005 |
| Manganese | .05–.4 | .2 |
| Iron | Bal | Bal |

Additionally, up to 1.5% molybdenum and/or up to 0.010 magnesium can be added to improve long-term mechanical properties.

Normally, alloys containing less than 40% nickel, regardless of heat treatment, will not form the gamma-double prime phase, and thus the alloy will not achieve its ultimate characteristics. It has been found, however, that the nickel content can be less than 40% where other considerations are taken into account. In this respect, it has been found that the aluminum content is critical and cannot exceed 0.6% where the nickel content is below 40%; for example, 37% nickel, and still obtain the gamma-double prime precipitate. While at first blush it may appear that a corresponding increase is also required in the zirconium content, it is not seen wherein zirconium content effects the transformation characteristics of this alloy. Moreover, a detrimental effect can be foisted upon the alloy where the zirconium content is too high since the alloy will not be able to be fabricated, for example, by a welding.

The foregoing alloys are characterized in having both the gamma-prime and gamma-double prime phases. At the same time, by virtue of the fact that the nickel content is beneath 40% by weight, the alloy is characterized by low neutron absorbence and at the same time has good swelling resistance under irradiation.

In order to derive the optimized alloy of the invention, a number of alloys were examined, the compositions of these alloys being listed in the following Table II:

TABLE II

| Alloy | Fe | Ni | Cr | Mo | Nb | Hf | Si | Mn | Mg | Zr | Ti | Al | C | B | Identified Precipitate |
|---|---|---|---|---|---|---|---|---|---|---|---|---|---|---|---|
| D32 | Bal | 37 | 12 | — | 4.0 | — | — | — | — | 0.03 | 2.8 | 0.8 | 0.03 | 0.010 | γ, n |
| D33 | Bal | 45 | 12 | — | 4.0 | — | — | — | — | 0.03 | 1.9 | 0.5 | 0.03 | 0.010 | γ, " |
| D66 | Bal | 45 | 12 | 3.0 | — | — | 0.5 | — | — | 0.05 | 2.5 | 2.5 | 0.03 | 0.005 | γ' |
| D31-M-5 | Bal | 37 | 12 | — | 3.0 | 0.03 | 0.5 | — | — | 0.03 | 1.9 | 1.9 | 0.03 | 0.01 | γ' |
| D31-M-6 | Bal | 37 | 12 | — | 3.0 | — | 0.5 | — | — | 0.05 | 2.5 | 2.5 | 0.03 | 0.005 | γ' |
| D31-M-7 | Bal | 37 | 12 | 2.0 | 4.0 | — | 0.5 | — | — | 0.05 | 0.8 | 0.6 | 0.03 | 0.005 | γ' |
| D31-M-8 | Bal | 37 | 12 | 4.5 | 4.0 | — | 0.5 | — | — | 0.05 | 0.8 | 0.6 | 0.03 | 0.005 | γ' |
| D31-M-9 | Bal | 37 | 15 | 3.0 | 4.0 | — | 0.5 | 0.2 | 0.02 | — | 1.0 | 0.4 | 0.04 | 0.005 | γ' |
| D310M-10 | Bal | 45 | 12 | — | 4.0 | — | 0.5 | 0.2 | 0.02 | 0.05 | 1.8 | 0.8 | 0.03 | 0.005 | γ' |
| D31-M-11 | Bal | 45 | 12 | — | 4.0 | — | 0.5 | 0.2 | 0.02 | 0.05 | 1.8 | 1.0 | 0.03 | 0.005 | γ' |
| D31-M-12 | Bal | 45 | 12 | — | 4.0 | — | 0.5 | 0.2 | 0.02 | 0.05 | 1.8 | 1.2 | 0.03 | 0.005 | γ' |
| D31-M-13 | Bal | 45 | 12 | 2.0 | 4.0 | — | 0.5 | 0.2 | 0.02 | 0.05 | 1.8 | 0.8 | 0.03 | 0.005 | γ' |
| D31-M-14 | Bal | 45 | 12 | 2.0 | 4.0 | — | 0.5 | 0.2 | 0.02 | 0.05 | 1.8 | 1.0 | 0.03 | 0.005 | γ' |
| D68 | Bal | 45 | 12 | — | 3.6 | — | 0.35 | 0.2 | 0.01 | 0.05 | 1.7 | 0.3 | 0.03 | 0.005 | γ' |
| D68-B1 | Bal | 45 | 12 | — | 3.0 | — | 0.3 | 0.2 | — | 0.05 | 1.6 | 0.5 | 0.03 | 0.006 | γ" |
| D68-B2 | Bal | 37 | 12 | — | 2.9 | — | 0.3 | 0.2 | — | 0.05 | 1.75 | 0.3 | 0.03 | 0.005 | γ', γ" |
| D68-C4 | Bal | 34 | 12 | — | 2.9 | — | 0.5 | 0.2 | — | 0.05 | 1.75 | 0.3 | 0.03 | 0.005 | γ' |

Alloys aged in the range of 16–24 hours at about 760° C.

From an examination of Table II, it can be seen that most alloys (e.g., alloys D31-M-5 to D31-M-9) containing less than 40% nickel do not contain the gamma-double prime phase unless the aluminum content is less than 0.6% by weight. Likewise, the nickel content must be greater than 33 to 35% to obtain the Γ" phase.

Stress rupture testing confirms that the 100-hour 650° C. stress rupture strength of alloy D68-B2 is about 586 Mpa, which is about the same as that measured for alloy D68. In addition, alloy D68-B2 has approximately a 10% lower neutron absorption cross section than alloy D68 which translates into a significant savings for fuel cladding applications.

As was stated previously, the lower nickel range together with the presence of the gamma-double prime precipitate is effective for showing an improved ductility. The ductility is most critical in the post irradiation mode, and therefore any improvement in the bend ductility is highly effective for making such materials eminently suited for use in fast breeder reactors.

In order to demonstrate this phenomenon, the alloys listed hereinafter, whose chemical composition and phase identification are set forth in Table II, were irradiated to a fluence of $6.9\times10^{22}$ neutrons per square centimeter at a temperature of 593°±25° C., and thereafter tested at 730° C. The disc test to which the hereinafter specified alloys were subjected is a specially designed microductility test in which an indentor is pushed through a disc onto a mandrel. This has been correlated with tensile testing and found to give identical results to bulk tensile testing. It is used for reactor testing specimens because it permits the utilization of reduced size and configuration samples in order to obtain the data. The discs that are normally tested are ⅛" or 3 mm in diameter and approximately 1/12,000" in thickness. The test is only accurate in the range of low ductility in which there is less than 2% ductility because the developmental work has not yet been completed on materials which exhibit higher ductilities. This test has been utilized by most of the major reactor manufacturers and is compatible with government testing requirements.

| Alloy Designation | Bend Ductility (%) |
|---|---|
| D68-B1 | 0.2 |
| D68-B2 | 0.8 |

As stated, the use of this material in a nuclear environment requires that the material as irradiated to normal fluences must demonstrate low swelling of the composition. In order to demonstrate this outstanding feature in the present invention, reference is had to the following table in which alloy D68-B2 was irradiated to the nominal fluences indicated. For comparison, the table also contains data on the swelling resistance of AISI Type 316 under the same conditions.

| PERCENT SWELLING ($6.9\times10^{22}$ n/cm$^2$) | | |
|---|---|---|
| Temperature °C. | 25% Cold Worked D68-B2 | 20% Cold Worked AISI 316 |
| 427 | −0.87 | +0.17 |
| 482 | −1.19 | +0.79 |
| 510 | −1.10 | +1.9 |
| 538 | −0.92 | +2.47 |
| 593 | −0.65 | +3.20 |
| 649 | −0.92 | +0.5 |

From the foregoing, it is noted that alloy D68-B2 is still densifying, while AISI Type 316 is well into the void swelling regime regardless of the temperatures employed. These data make it clear that the alloys of the present invention are particularly suitable for use, for example, in a fast breeder reactor.

While the invention has been described in connection with certain specific embodiments, it will be readily apparent to those skilled in the art that various changes in compositional limits can be made to suit requirements without departing from the spirit and scope of the invention.

What is claimed is:

1. An iron-nickel-chromium age hardenable alloy characterized in having γ' and γ" phases present and consisting essentially of about 37% nickel, 12% chromium, 2.9% niobium, 0.2% silicon, 0.05% zirconium, 1.75% titanium, 0.3% aluminum, and the remainder essentially all iron.

* * * * *